United States Patent [19]

Sturzenegger et al.

[11] Patent Number: 4,471,187

[45] Date of Patent: Sep. 11, 1984

[54] GAS-BLAST SWITCH

[75] Inventors: Christian Sturzenegger, Wettingen; Bruno Aeschbach, Rombach; Heinz Aeschbach, Reinach; Willi Schütz, Aarau, all of Switzerland

[73] Assignee: Sprecher & Schuh AG, Aarau, Switzerland

[21] Appl. No.: 422,372

[22] Filed: Sep. 23, 1982

[30] Foreign Application Priority Data

Sep. 30, 1981 [CH] Switzerland ..... 6297/81

[51] Int. Cl.[3] ..... H01H 33/88

[52] U.S. Cl. ..... 200/148 R; 200/148 A; 200/148 C; 200/150 G

[58] Field of Search ..... 200/148 R, 148 A, 148 C, 200/148 E, 150 G

[56] References Cited

U.S. PATENT DOCUMENTS 4,328,403 5/1982 Frink et al. ..... 200/148 A

FOREIGN PATENT DOCUMENTS 566685 1/1945 United Kingdom ..... 200/148 C

*Primary Examiner*—E. A. Goldberg
*Assistant Examiner*—Morris Ginsburg
*Attorney, Agent, or Firm*—Werner W. Kleeman

[57] ABSTRACT

A gas-blast switch or circuit-interrupter contains a fixed set of contacts and a movable set of contacts. Each contact set possesses an arc contact and a rated current contact coaxially surrounding the related arc contact. Operatively associated and co-movable with the movable contact set is a blast nozzle which surrounds the arc contact of such movable contact set. In the cut-on position the blast nozzle is closed by the fixed arc contact and is operatively connected with a pressure chamber which can be pressurized during a cut-off stroke. At the outflow end of at least one of the arc contacts there are arranged means in order to axially and outwardly deflect the switching gas flowing-out of such end during the cut-off stroke. The deflecting means comprise deflection hoods of essentially cup-shaped configuration which are open at their ends confronting one another and possess a base or floor portion containing a half toroidally shaped deflection surface at the peripheral edge of which there merges an essentially cylindrical portion or section. Each such cylindrical portion carries a plurality of tongues which protrude inwardly from its inner wall and which are arranged at a substantially uniform circumferential spacing from one another.

14 Claims, 3 Drawing Figures

GAS-BLAST SWITCH

BACKGROUND OF THE INVENTION

The present invention relates to a new and improved construction of a gas-blast switch or circuit-interrupter.

Generally speaking, the gas-blast switch or circuit-interrupter of the present development is of the type comprising a set of fixed contacts and a set of movable contacts. Each contact set comprises an arc contact through which there can be axially blown a gas and a rated current contact coaxially surrounding the arc contact. Additionally, there is provided a blast nozzle which is co-movable with the movable contact set. The blast nozzle surrounds the arc contact of the movable contact set, the blast nozzle being closed in the cut-on position of the gas-blast switch by the fixed or stationary arc contact. Furthermore, the blast nozzle flow communicates at its inlet side with a pressure chamber or compartment which can be pressurized during the cut-off stroke, and at the outflow-located end of at least one of the arc contacts there are arranged means in order to axially and outwardly deflect the switching gas which outflows at such end during the cut-off stroke.

Switches or circuit-interrupters of the aforementioned type are known, for instance, from U.S. Pat. No. 4,149,051, granted Apr. 10, 1979, and U.S. Pat. No. 4,144,426, granted Mar. 13, 1979. With these state-of-the-art circuit-interrupters the outflow-located end of both arc contacts is surrounded by a cooler composed of superimposed wound layers formed of metal fabric. This cooler or cooling device cools the effluxing hot switching gas and also at least partially axially deflects its flow. However, such cooling devices or coolers constitute an obstruction for the gas flow or stream which suddenly flows-in during a cut-off stroke. This obstruction can lead to the result that the gas flow effluxing from the blast nozzle, after blowing the switching arc and before this gas flow reaches the outflow-located end of the arc contact, is superimposed to a certain extent upon a "standing wave", i.e. pronounced oscillations are formed in the gas flow departing from the blast nozzle, which alternately result in the formation, and then with an extremely high frequency, of regions having higher and lower pressures in such gas flow. However, a reduced gas pressure also means a reduced gas density, and thus, a reduced dielectric strength of the gas, to the extent that such can still partially be ionized.

A further switch or circuit-interrupter of the previously mentioned type is also known from U.S. Pat. No. 4,095,068, granted June 13, 1978. With this circuit-interrupter the fixed arc contact is retained internally of a contact tube which, at a location flow downstream of the outflow-located end of the fixed arc contact, possesses gill-like circumferential slots bounded by guide vane-shaped ring segments. By means of these ring segments a part of the switching gas departing from the stationary arc contact is deflected outwardly and axially. However, the deflected switching gases, with this construction of circuit-interrupter, arrive at a jacket chamber surrounding the contact tube. This jacket chamber is pierced by cooling metal plates, the surfaces of which are located parallel to the switch axis. Also, these cooling metal plates constitute a hinderance or obstruction for the gas flow which suddenly is formed during the cut-off stroke, which is not only a consequence of the extinguishing or quenching gas flowing out of the pressure chamber, but also a consequence of the sudden heating of the extinguishing gas at the region of the switching arc.

With the heretofore known constructions of circuit-interrupters the heated switching gases must displace a so-to-speak "plug" of initially still cool extinguishing or quenching gas present at the outflow side, and this gas plug only can be displaced against the action of the aforementioned obstruction. This phenomenon can lead to the formation of the previously mentioned oscillation which is superimposed upon the flow (comparable to the oscillations of an air column in an organ pipe), and results in the prior explained undesirable consequences.

A further prior art construction of gas-blast switch or circuit breaker is exemplified by the commonly assigned U.S. Pat. No. 3,941,962, granted Mar. 2, 1976.

SUMMARY OF THE INVENTION

It is a primary object of the present invention to provide a new and improved construction of gas-blast switch of the previously mentioned type, wherein there are extensively avoided the aforementioned drawbacks.

Another important object of the present invention is directed to an improved construction of gas-blast switch which is relatively simple in construction and design, quite economical to manufacture, extremely reliable in operation, not readily subject to breakdown or malfunction, and requires a minimum of servicing and maintenance.

Yet a further important object of the present invention is directed to a new and improved construction of gas-blast switch of the aforementioned type which is constructed such that during a cut-off stroke the displacement of the "plug" of cold extinguishing or quenching gas can be accomplished in the presence of a minimum amount of resistance, and the cooling of the hot switching gas is not accomplished in the first instance by convection at cooling surfaces, but by commingling the hot switching gas with the still cool extinguishing or quenching gas of the "plug" which has not been in direct contact with the switching arc.

Now in order to implement these and still further objects of the invention, which will become more readily apparent as the description proceeds, the gas-blast switch or circuit-interrupter of the present development is manifested by the features that, the outflow-located ends of both arc contacts are each spanned or straddled by a respective essentially cup-shaped deflection hood or hood member. These deflection hoods are open at their mutually confronting ends and each hood is provided with a base or floor containing a half-toroidally shaped deflection surface at the outer edge or marginal region of which there merges an essentially cylindrical portion which carries a plurality of tongues which protrude inwardly from its related inner wall. These tongues are arranged at a substantially uniform circumferential spacing from one another.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
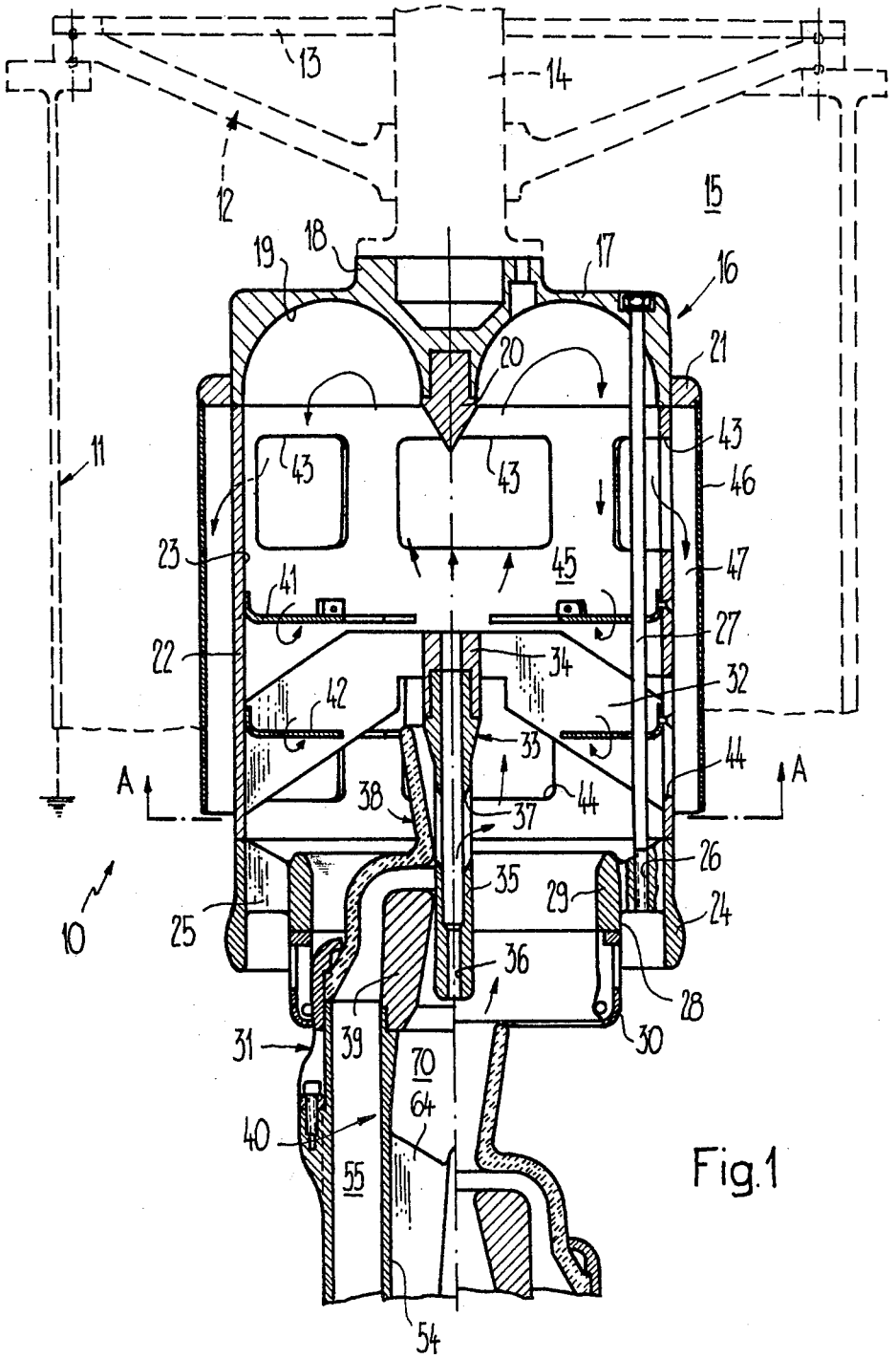
FIG. 1 is an axial sectional view through a portion of a metal-encapsulated gas-blast switch, wherein there have been primarily depicted the set of fixed or stationary contacts, whereas the parts of the switch which are less important as concerns the actual teachings of the invention have been shown in phantom or broken lines, and furthermore the left-hand portion shows the depicted gas-blast switch in its cut-on position and the right-hand portion shows the gas-blast switch in its cut-off position.
Figure 2:
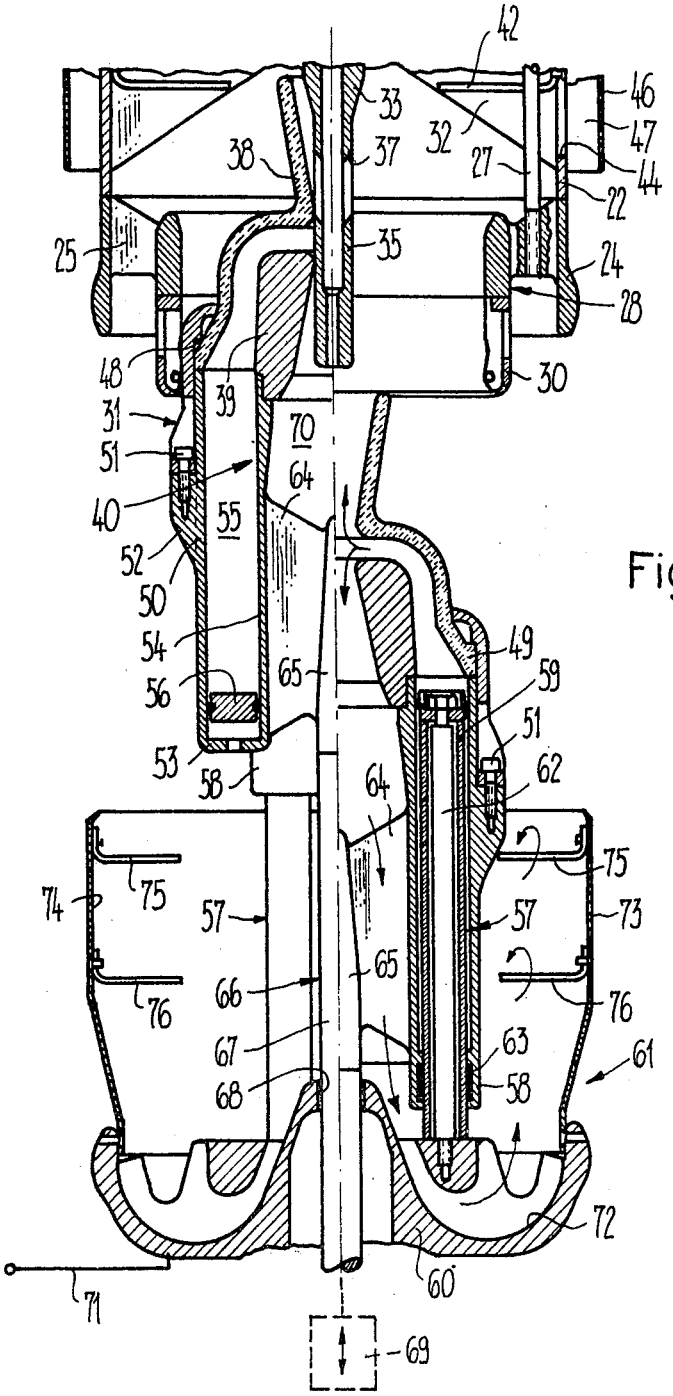
FIG. 2 is an axial sectional view especially through the remaining part of the gas-blast switch depicted in FIG. 1, wherein the switch housing has been conveniently omitted in order to enhance the illustration of the drawings and the understanding thereof.

Turning attention now to the drawings, initially reference will be made to FIGS. 1 and 2 depicting therein an exemplary embodiment of gas-blast switch or circuit-interrupter according to the invention. The illustrated switch construction constitutes a metal-encapsulated gas-blast switch 10 containing an essentially tubular-shaped metallic housing 11 within which there is located at excess pressure a suitable extinguishing or quenching gas, typically for instance $SF_6$. At its upper end the metallic housing 11 is sealingly closed by means of a support insulator 12 which, in turn, is fixedly clamped by means of a substantially ring-shaped flange 13. Extending centrally through the support insulator 12 is a merely schematically depicted connection conductor 14 which is sealingly enclosed by the support insulator 12. At the lower end of the connection conductor 14, which protrudes into the internal space or chamber 15 of the housing 11, there is attached a deflection hood, generally designated in its entirety by reference numeral 16.

This deflection hood or hood member 16 possesses a base or floor portion 17 at the outer side or surface of which, confronting the support insulator 12, there is formed a support or flange 18 for receiving the lower part of the connection conductor 14. The side or surface of the base or floor portion 17 which is situated opposite the support or flange 18 possesses a deflection surface 19. This deflection surface 19 is in the form of a hollow, half-toroidal shape and there is inserted a conically tapered flow body 20 into the base or floor portion 17 at the axis of this half-toroidally shaped deflection surface 19. At the height of the peripheral edge of the base or floor portion 17 there is secured at its outer side or surface an attachment and spacer ring 21, for instance by means of any suitable and therefore not particularly illustrated pins or threaded bolts or equivalent fastening devices.

Merging with the metallic base portion 17 is a likewise metallic, substantially cylindrical portion or section 22, the inner surface or wall 23 of which is in alignment with the peripheral edge or portion of the deflection surface 19. This cylindrical portion 22 is snugly pressed against the base or floor portion 17 by means of a holder or retaining ring 24. The holder ring 24 has its inner and outer diameters essentially corresponding to the inner and outer diameters of the cylindrical portion or section 22. Protruding from the inner surface or wall of the metallic holder ring or ring member 24 are support ribs or rib members 25, for instance four such support ribs 25 which extend radially towards the inside. Provided in such support ribs 25 are threaded bores 26, only one of which has been particularly illustrated, and into such threaded bores 26 there can be threaded the tensioning or clamping bolts 27 or equivalent structure, the not particularly referenced head portions of which are supported by the base or floor portion 17, as particularly shown at the upper right-hand portion of FIG. 1. The support ribs 25 carry at their inner ends a support ring member 29 forming part of a fixed or stationary rated current contact 28. At the lower end face or side of the support ring member or ring 29 there is affixed a rim of radially outwardly resiliently deflectable contact fingers 30. These resilient contact fingers 30, in the cut-on position of the gas-blast switch, as shown at the left-hand side of the illustration of FIG. 1, are in engagement with a movable rated current contact 31, the construction and remaining function of which will be described more fully hereinafter in conjunction with FIG. 2.

At the inner wall or surface 23 of the cylindrical portion 22 there are likewise attached radially inwardly protruding support ribs or strut members 32. These support ribs 32 are preferably aligned with the support ribs or rib members 25 and carry at their inner ends a substantially tubular-shaped hub portion or hub 34 forming a part of a fixed or stationary arc contact 33. Secured in such hub portion 34 so as to be exchangeable, for instance by providing appropriate threads, is a substantially tubular-shaped break or burn-off contact pin 35 which forms the other part of the stationary or fixed arc contact 33. Owing to the duct-like or tubular-shaped construction of the break contact pin 35 gas can be blown therethrough. This break contact pin 35 possesses a central bore 36 which emanates from its free end, this bore 36 widening and being provided with lateral through passages or openings 37 forwardly of the free end of the break contact pin 35. Furthermore, the stepped bore 36 continues into the not particularly referenced bore provided in the hub portion 34.

As will be recognized by reverting again to FIG. 1, the break contact pin 35, in the cut-on position of the gas-blast switch, closes a blast nozzle 38 belonging to the movable parts or components of the gas-blast switch. This blast nozzle 38 is formed of a suitable electrically insulating material, for instance from PTFE. The break contact pin 35 engages into an essentially tubular-shaped end piece 39 which forms the movable arc contact 40 in the sense that at this end piece 39 there is applied the one base point or root of the switching arc.

At the inner wall or surface 23 of the cylindrical portion 22 there are secured two sets of tongue members or tongues 41 and 42. Each set of tongue members or tongues 41 and 42 contains six such tongues which are attached at a substantially uniform circumferential spacing from one another, and the sets of tongues 41 and 42 are arranged in two different planes or tiers. The tongues 41 and 42 are preferably formed of a conductive material, are planar and are preferably oriented such that their planes extend transversely with respect to the axis of the cylindrical portion 22. Each of the tongues 41 are turned or offset with respect to the tongues 42 through an angle of about 30°, and which is not readily apparent from the illustration of FIG. 1 because it has been shown in a simplified portrayal, but can be recognised by inspecting FIG. 3. The function of the tongues or tongue members 41 and 42 will be explained more fully hereinafter.

Finally, at the cylindrical portion or section 22 there are formed windows or passages 43 and 44 which extend radially towards the outside from the inner space or chamber 45 of the deflection hood 16. These windows 43 and 44 are covered by a thin-wall tube or pipe 46, preferably formed of metal. This tube or pipe 46 surrounds the cylindrical portion 22 at a radial spacing therefrom and is secured to the attachment ring or ring member 21. Between the tube 46 and the outer jacket surface of the cylindrical portion 22 there is thus formed a jacket or outer chamber 47 which is open at its lower region, as best seen by referring to FIG. 1. The free end of the cylindrical portion 22 extends past the thin-wall tube or tube member 46.

Turning attention now to FIG. 2, there will be recognized at the upper portion thereof essentially those parts previously described and which are located at the lower portion of the arrangement of FIG. 1, so that apart from identifying the same parts with the same reference numerals no further description thereof appears to be necessary. From the illustration of FIG. 2, it will be also apparent that the movable rated current contact 31 possesses a shoulder 48, by means of which an inlet-side circumferential flange 49 of the blast nozzle 38 is fixedly clamped at the end surface or face of an outer metallic cylinder or cylinder member 50. For this purpose the movable rated current contact 31 is fixedly bolted or screwed by means of the threaded bolts 51 axially upon a circumferential bead or rim 52 which protrudes outwardly from the cylinder 50, This cylinder 50 is connected by means of an essentially ring-shaped base or floor 53 formed of electrically conductive material with an inner, likewise metallic cylinder or cylinder member 54 which simultaneously constitutes a part of the movable arc contact and in this respect serves as the blow-out tube and for carrying current. At the upper end face or side of the inner cylinder 54 there is exchangeably attached, for instance threadably bolted, the already mentioned end piece or member 39.

The jacket or outer chamber provided between the cylinders or cylinder members 50 and 54 constitutes a pump or pressure chamber 55 which, at one end, directly leads into the blast nozzle 38 and, at the other end, is bounded by a stationarily supported ring-shaped or annular pump piston 56. This pump piston 56 is sealed with respect to the outer wall or surface of the cylinder 54 and also with respect to the inner wall or surface of the cylinder 50 and both of these cylinders 50 and 54 are displaceable along the annular pump piston 56.

This pump piston 56 is supported upon a number of column members 57, in the embodiment under discussion three such column members 57. Each column member 57 piercingly extends through a passage or opening 58 formed at the base or floor 53. As best seen by referring to the right-hand portion of FIG. 2, each column member 57 contains a metallic spacer or distance sleeve member 59. Each such spacer sleeve or sleeve member 59 is supported at one end at the side or face of the pump piston 56 facing away from the pressure chamber or compartment 55 and at the other end is appropriately supported at the base or floor portion 60 of a further deflection hood or hood member 61. Each spacer sleeve 59 is clamped by means of a tightening or clamping bolt 62 piercingly extending through the related spacer sleeve 59 and threadably connected with the base or floor portion 60. Additionally, engaging at the outer surface of each spacer sleeve 59 is a sliding or wiper contact 63 inserted into each of the passages 58. These sliding contacts 63 ensure for a good electrical connection between the galvanically coupled cylinders 50 and 54 and, by means of the spacer sleeves 59, the base or floor portion 60.

Protruding radially inwardly from the inner wall of the cylinder 54 are a number of support ribs or rib members 64 which carry an assisting or aerodynamic end portion 65 of a drive rod 66. At the end portion 65 there merges a traction and thrust rod 67, preferably formed of an electrically insulating material, such rod or rod member 67 being displaceably guided through a central bore or hole 68 in the base or floor portion 60 and, as shown in broken lines, being operatively coupled with a suitable drive or drive means 69.

From what has been previously explained it will be apparent that the movable rated current contact 31, the movable arc contact 40 and the blast nozzle 38 are fixedly coupled with the drive rod 66. Furthermore, it will be recognized that the movable arc contact 40 composed essentially of the end piece 39 and the inner cylinder 54, has gas blown therethrough as soon as the end piece 39 is released from the fixed arc contact 33 during the course of a cut-off stroke, and the flow channel 70 extending through the support ribs 64 which do not offer any appreciable flow resistance.

The outflow-side end of the movable arc contact 40 is spanned or straddled by the previously mentioned deflection hood 61, the base or floor portion 60 of which, as already explained, is stationarily arranged, and therefore, also serves as the connection location for the second connection conductor or line 71. Also, this base or floor portion 60 possesses at its face or side confronting the movable arc contact 40 a deflection surface 72 which surrounds the bore 68. This deflection surface 72 is in the form of a half hollow torus. Also the deflection hood 61 possesses an essentially cylindrical portion or section 73 which tangentially merges at the peripheral portion of the deflection surface 72 of the base or floor portion 60 and is appropriately secured thereat. At the inner side or wall 74 of the substantially cylindrical portion 73 there are secured in two planes or tiers a respective set of tongue members 75 and 76. These planes extend essentially perpendicular to the lengthwise axis of the substantially cylindrical portion 73. These tongues or tongue members 75 and 76 are likewise conductive, planar and arranged at right angles with respect to the axis of the cylindrical portion 73 and also are distributed at a substantially uniform circumferential spacing from one another. There are provided, for instance, likewise six tongues 75 and six tongues 76, wherein, just as was the case for the tongues or tongue members 41 and 42, here also the tongues 75 are arranged to be turned or offset through an angle of about 30° in relation to the tongues 76, something which is not directly discernible from the illustration of FIG. 2. Each of these tongues 41, 42, 75 and 76 may have a substantially rectangular cross-sectional configuration and may extend radially, at most, through one-half of the radius of the related cylindrical portions 22 and 73, respectively. Also, the total surface area of all tongues located in the same plane may, at most, not exceed approximately 20% of the through flow cross-section of the related cylindrical portion measured in such plane.

As long as the arc contacts 33 and 40 are in engagement, then during a cut-off stroke of the gas-blast switch it will be apparent that initially, the extinguishing or quenching gas which is present in the pump chamber or compartment 55 is pre-compressed. As soon as the end piece 39 departs from the break contact pin 35, but still before such has freed or opened the blast nozzle 38, there is started with the blowing of the switching arc which has been drawn between the parts or components 39 and 35. The heated switching gases initially flow-off through the flow channel 70, are outwardly and axially deflected at the deflection surface 42, and then arrive at the cylindrical portion 73 containing the tongues 75 and 76, where, due to the presence of such tongues, such heated switching gases are intensively admixed with the still cool extinguishing or quenching gas which already previously was present in the cylindrical portion 73, without there arising the formation of a so-to-speak "standing wave" which is superimposed upon the flow. This is because the gas flow need only overcome a minimum of flow resistance. As soon as the blast nozzle 38 has been freed from the break contact pin 35, there is accomplished the blowing of the switching arc also in the direction of the fixed contacts. The gases which outflow in this direction impinge upon the deflection surface 19, and are outwardly and axially deflected at such deflection surface 19. Already prior thereto the switching gases which flow-off in this direction can be commingled by the action of the tongues 41 and 42 with cool extinguishing or quenching gas. However, this admixing or commingling occurs, in any case after the deflection, and the windows or passages 43 and 44 or the like additionally enhance both the displacement of the still cool extinguishing gas and also the outflow of the switching gas-extinguishing gas-mixture with a minimum amount of flow resistance. Both in the illustration of FIG. 1 and also in the illustration of FIG. 2 the gas flow arising during a cut-off stroke has been indicated by the arrows.

Figure 3:
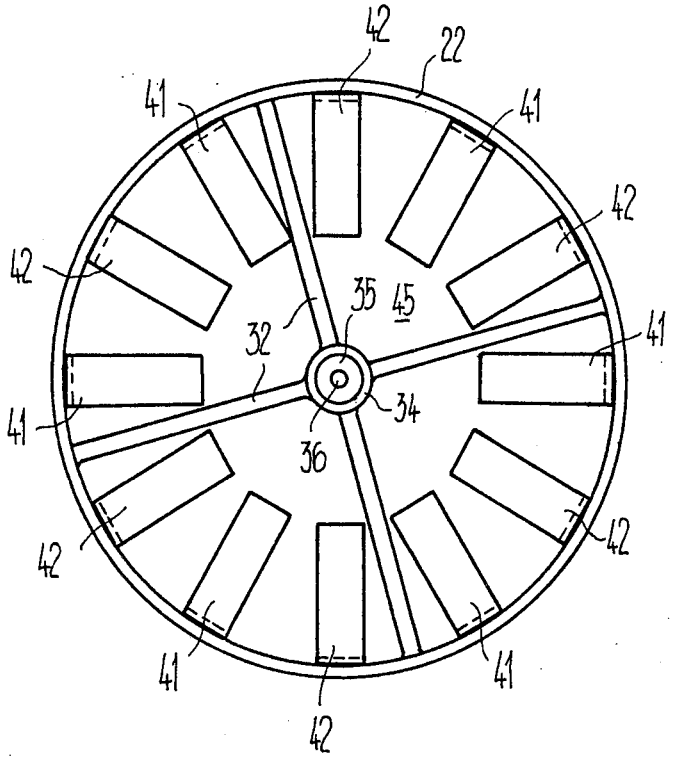
FIG. 3 illustrates in an enlarged scale a top plan view of the gas-blast switch depicted in FIG. 1, looking in the direction of the arrows A—A thereof, and showing such gas-blast switch in its cut-off position and without the switch housing.

Finally, at this point reference is now made to FIG. 3 in which there have been illustrated the previously discussed geometric arrangement of the tongues 41 and 42 and the support ribs 32 located in the inner space or chamber 45 enclosed by the substantially cylindrical portion 22. In this illustration there has not however been depicted the thin-wall tube member 46.

It should be understood that also the deflection hood 61 which is operatively associated with the set of movable contacts 31, 40 can be designed similar to the deflection hood 16 so as to contain windows or passages and can be provided with a thin-wall tube member covering such in radial spaced relationship therefrom. Additionally, it is also possible to inclinably position the tongues or tongue members 41, 42, 75 and 76 similar to the buckets or blades of a blower impellor, in order to thus additionally impart to the outflowing gases a spin or twist which is advantageous for cooling and deionization.

While there are shown and described present preferred embodiments of the invention, it is to be distinctly understood that the invention is not limited thereto, but may be otherwise variously embodied and practiced within the scope of the following claims. Accordingly,

What we claim is:

1. A gas-blast switch comprising:

a set of fixed contacts;

a set of movable contacts;

each said set of contacts comprising an arc contact through which there can be blown gas and a rated current contact coaxially surrounding said arc contact;

a blast nozzle co-movable with said movable set of contacts;

said blast nozzle surrounding the arc contact of the movable contact set and in a cut-on position of the gas-blast switch being closed by the fixed arc contact;

means defining a pressure chamber which can be pressurized during a cut-off stroke;

said blast nozzle having an inlet flow communicating with said pressure chamber;

each said arc contact defining a related outflow-side end;

means arranged at said outflow-side end of each one of the arc contacts in order to axially and outwardly deflect switching gases outflowing from such ends during a cut-off stroke of the gas-blast switch;

said deflecting means comprising a respective substantially cup-shaped deflection hood spanning the related outflow-side end of each arc contact;

said deflection hoods being open at ends thereof confronting one another;

each of said deflection hoods being provided with a respective base portion containing a substantially half toroidally-shaped deflection surface;

each deflection surface having an outer edge at which merges an essentially cylindrical portion having an inner wall; and each cylindrical portion carrying a plurality of tongues protruding inwardly from its inner wall and arranged at a substantially uniform circumferential spacing from one another.

2. The gas-blast switch as defined in claim 1, wherein:

said tongues have a substantially flat planar construction; and said tongues being arranged so that their planes are disposed transversely with respect to a lengthwise axis of the related cylindrical portion.

3. The gas-blast switch as defined in claim 2, wherein:

said tongues possess an essentially rectangular configuration.

4. The gas-blast switch as defined in claim 2, wherein:

said tongues are arranged in groups in a number of planes located transversely with respect to a lengthwise axis of the cylindrical portion.

5. The gas-blast switch as defined in claim 4, wherein:

said tongues of one group are arranged in offset relation in circumferential direction in relation to the tongues of the neighbouring group.

6. The gas-blast switch as defined in claim 1, wherein:

said tongues extend radially at most through one-half of the radius of the related cylindrical portion.

7. The gas-blast switch as defined in claim 4, wherein:

the total surface area of all tongues arranged in a plane at most amounts to 20% of the throughflow cross-section of the related cylindrical portion measured in such plane.

8. The gas-blast switch as defined in claim 5, wherein:

the total surface of all tongues arranged in a plane at most amounts to 20% of the throughflow cross-section of the related cylindrical portion measured in such plane.

9. The gas-blast switch as defined in claim 1, further including:

passages provided at the cylindrical portion of at least one of the deflection hoods;

a thin-wall tube member for spanning said passages; and said thin-wall tube member surrounding said cylindrical portion in radial spaced relationship therefrom.

10. The gas-blast switch as defined in claim 1, wherein:

said deflection hood which is operatively associated with the movable arc contact is stationarily arranged.

11. The gas-blast switch as defined in claim 9, wherein:

a jacket chamber is formed between the cylindrical portion and the thin-wall tube member; and said jacket chamber is open at least at an end thereof confronting a free edge of the cylindrical portion.

12. The gas-blast switch as defined in claim 11, wherein:

said free edge of the cylindrical portion protrudes past the thin-wall tubular member.

13. The gas-blast switch as defined in claim 1, wherein:

said cylindrical portion of the deflection hood operatively correlated with the set of fixed contacts contains two types of inwardly protruding support ribs; and the one type of inwardly protruding support ribs supports the fixed arc contact and the other type of inwardly protruding support ribs supports the fixed rated current contact.

14. A gas-blast switch comprising:

a set of fixed contacts;

a set of movable contacts;

each set of contacts comprising a rated current contact coaxially surrounding a substantially tubular arc contact;

each of said tubular arc contacts having a contact end and an outflow end remote from said contact end;

a blast nozzle co-movable with said set of movable contacts;

said blast nozzle surrounding the tubular arc contact of the set of movable contacts and in a cut-on position of the gas-blast switch being closed by the tubular arc contact of the set of fixed contacts;

means defining a pressure chamber which can be pressurized during a cut-off stroke of the gas-blast switch;

said blast nozzle having an inlet communicating with said pressure chamber;

means spaced arranged at and surrounding the outflow end of each one of the tubular arc contacts for outwardly deflecting and axially guiding switching gases outflowing from such ends during said cut-off stroke of the gas-blast switch;

each of said deflecting means comprising a substantially cup-shaped deflection hood spanning the outflow end of the respective tubular arc contact;

said deflection hoods being open at ends thereof confronting one another;

each of said deflection hoods being provided with a base portion having a deflection surface which in cross-section has the shape of a hollow substantially half toroidal shell coaxially disposed relative to the respective tubular arc contact;

each deflection surface having an outer edge with which merges an essentially cylindrical portion having an inner wall; and each cylindrical portion carrying a plurality of tongues protruding inwardly from its inner wall and arranged at a substantially uniform circumferential spacing from one another.

* * * * *

UNITED STATES PATENT AND TRADEMARK OFFICE

CERTIFICATE OF CORRECTION

PATENT NO. : 4,471,187

DATED : September 11, 1984

INVENTOR(S) : CHRISTIAN STURZENEGGER et al

It is certified that error appears in the above—identified patent and that said Letters Patent is hereby corrected as shown below:

Column 6, line 10, delete "assisting" and replace it with --flow-assisting--

Signed and Sealed this

*Twenty-sixth* Day of *March 1985*

[SEAL]

*Attest:*

DONALD J. QUIGG

*Attesting Officer*

*Acting Commissioner of Patents and Trademarks*